United States Patent [19]

Petrini

[11] Patent Number: 4,797,952

[45] Date of Patent: Jan. 17, 1989

[54] THROWAWAY BIB

[76] Inventor: Grace Petrini, 4299 W. Carlin Rd., Stockton, Calif. 95206

[21] Appl. No.: 96,443

[22] Filed: Sep. 15, 1987

[51] Int. Cl.[4] ..... A41B 13/10

[52] U.S. Cl. ..... 2/49 R; 2/50

[58] Field of Search ..... 2/49 R, 50, 46, 48

[56] References Cited

U.S. PATENT DOCUMENTS

| | | | |
|---|---|---|---|
| 2,620,475 | 12/1952 | Legg et al. | 2/50 |
| 2,900,640 | 8/1959 | Haydu | 2/49 R |
| 3,654,629 | 4/1972 | Crisman et al. | 2/49 R |
| 4,416,025 | 11/1983 | Moret et al. | 2/49 R |
| 4,475,250 | 10/1984 | Savin et al. | 2/49 R |
| 4,646,365 | 3/1987 | Suprise et al. | 2/49 R |
| 4,706,303 | 11/1987 | Van Gompel et al. | 2/49 R |

*Primary Examiner*—Louis K. Rimrodt
*Assistant Examiner*—Judith L. Olds
*Attorney, Agent, or Firm*—Mark C. Jacobs

[57] ABSTRACT

A throwaway bib which due to the nature of its construction can be rinsed several times and reused as may be desired. The device comprises a two layer laminate the first of which layers is adapted to absorb moisture while the second layer is water impervious to thereby protect the clothes. An optional pocket for receiving solid foods and for catching dripping liquids may be included.

7 Claims, 1 Drawing Sheet

THROWAWAY BIB

BACKGROUND OF THE INVENTION

When parents take infants and small children to restaurants, on many occasions the restaurant is unable to supply a bib for the child. In other instances, the bib that the restaurant does supply is one of a flexible plastic film, which while able to protect the clothes in part, does permit solid particles and liquid spilled thereon to roll off or drip off the bottom of the bib onto the child's clothes. To solve these two problems, parents have often taken it upon themselves to bring their own bibs to restaurants. This practice can create other problems in that the bib can be left behind thereby causing a financial loss. In addition, it is not practical to carry away a soiled bib as there is no way to prevent the food and drink from getting onto ones hands, as travellers rarely have zip lock plastic bags at their instant disposal.

There is a need therefore for a throwaway price type of bib which under some circumstances can be re-used after easy cleaning.

There is a need further for a low-priced bib that will protect the clothes by not only preventing liquid from dripping down and solid particles from getting onto clothes but which bib will absorb milk juice and other liquids, whether used in the home or at a restaurant.

It is an object therefore to provide a throwaway price and construction bib, which can be reused if necessary. It is another object to provide a bib which can be washed in a washing machine, or rinsed under the faucet for reuse during periods of travel or when replacements are not available.

It is yet another object to provide a bib which will absorb moisture from food and drink, and which will not permit the moisture to pass through the bib to the child's clothes.

It is still a further object to provide a low priced high quality bib with a built-in pocket thereon to capture solid particles and liquid spills to prevent same from getting on the lap area of a child.

This and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

A low cost, throwaway if desired but reuseable if necessary, child's bib having an optional pocket for receiving spilt solid food and liquids. Due to the construction employed, the bib made of a laminate of (1) polyester nylon absorbent layer and (2) a water impermeable under layer, can be reused as may be desired and which will prevent the clothes of the wearer from becoming soiled.

DESCRIPTION OF THE PREFERRED EMBODIMENT

Reference should now be made to the first figure, wherein the throwaway bib of this invention is depicted. The device denoted as 10, includes a generally rectangular main panel which has an upper transverse edge and a lower transverse edge and being of two-ply sheet material specifically chosen for certain qualities, more about which will be stated below. The term generally rectangular is used, as the device may or may not have chamfered or rounded corners at the upper and/or the lower corners. However, due to the nature of the material employed, there will not be any "sharp" corners which could injure a baby or toddler, even if the corners were not rounded at all.

The main panel 11 includes a preferably circular opening 12 for the head of the wearer, not seen, and is sized to permit the head to pass snugly therethrough. The opening 12 is located near the top of the main panel 12, but spaced down somewhat from the upper transverse edge, in order to significantly reduce the possibility that the wearer could rip off the bib by a downward pulling force against his or her neck. **12*a*** indicates the relative size of the opening prior to sewing in the plastic as is explained below.

Surrounding the opening 12 is gathered portion 13. The gathered portion 13 can be prepared by any one of several conventional methods known to the art. Such methods include stitching the area with a resilient thread as well as forming a seam around the periphery of the opening **12*a* and sewing in a piece of elastic with the section to be hemmed. The gathered portion acts to bring about a closer fit between the opening 12** and the neck of the wearer than can be achieved without the use of the gathered portion. It thus helps reduce the number of spills running down a child's chin and thereby reaching his or her clothes.

Figure 2:
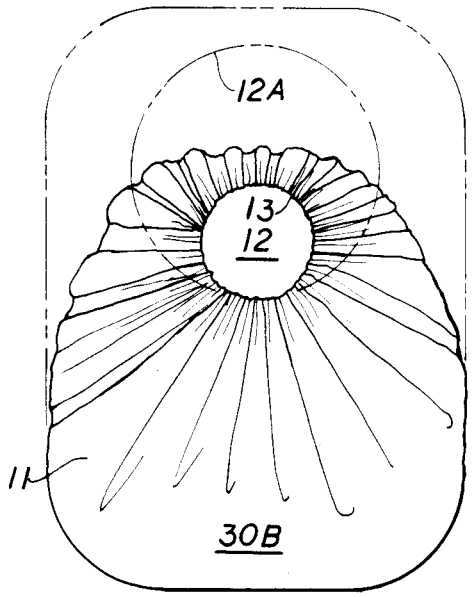
FIG. 2 is a rear elevational view thereof.

Reference is made momentarily to FIG. 2, the rear view thereof. It is seen that the gathered portion 13 is formed from both of the two layers 30A and 30B. By doing so, an attachment of the front layer and the rear layer, other than just the sonic welding or glue used to attach one to the other is achieved. It is seen therefore, that the two plies are coextensive with each other.

A pocket section 15 is provided at the bottom of the main panel 11, extending up from all along the lower edge 17 of the main panel 11, to a point about 20–25% of the elevation of said panel; namely point 18. Pocket 15 has a transverse opening 16 at the top thereof, to catch solid and liquid food not reaching the mouth. Pocket 15 may be secured to main panel 11 as by sonic welding or by adhesing together by a conventional suitable adhesive.

Figure 3:
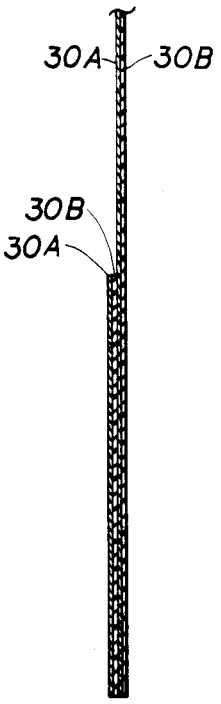
FIG. 3 is an enlarged right side partial sectional view thereof, the left side is a mirror image thereof.

FIG. 3 illustrates a right side elevational view of device 10 depicting the use of the two-ply material for both the pocket 15 and main panel 11, wherein the edge of the pocket 15 is shown secured to the side edge 14 of main panel as discussed above.

The bib as noted is formed of two layer material. The front layer 30A is formed of Pellon, a brand of an 80% polyester and 20% nylon sheet manufactured by Pellon Co N.Y., N.Y., 10018. Layer 30B is a polyvinyl chloride or other similar self supporting substantially impermeable flexible film, which will not permit fluid to pass through to the wearer's clothing.

One of these flexible layers may be fused, glued, sonic welded or even stitched or otherwise bonded to the other flexible layer as may be desired.

While I have recommended the Pellon product, any similar woven or unwoven fabric, but not paper may be utilized. The reason for this limitation is the fact that it is my desire that the bib be capable of being produced inexpensively enough to permit it to be a throwaway product. However it is also my desire, the bib can be sink rinsed and reused as may be necessary as when dining at a restaurant after a major food spill. If paper were employed for layer 30A, it would be incapable of being gently rinsed out in the rest room.

For the sake of ease of manufacturing, the pocket should preferably be made of the same material as the main body of the bib. In any event, the materials used must exhibit the same properties, including the "rinsability" feature. Obviously the bib of this invention is intended to be lightly rinsed out only. It is not intended for continuous machine washing and drying cycles. At most 3–5 hand rinsings are foreseen. Even at that, the number of rinsings will depend on the nature of the spill and the quantity thereof.

Several sizes of the device 10 are foreseen. These would be small, for 0–9 months; medium, 10 months–2 years; and large for toddlers up to about 3.5 years old + or −.

The materials utilized herein are available in white and other solid colors. Each bib may be packaged in its own plastic zip type bag to permit the device to be carried in a mother's handbag as well lending itself for ready distribution by a restaurant.

Figure 1:
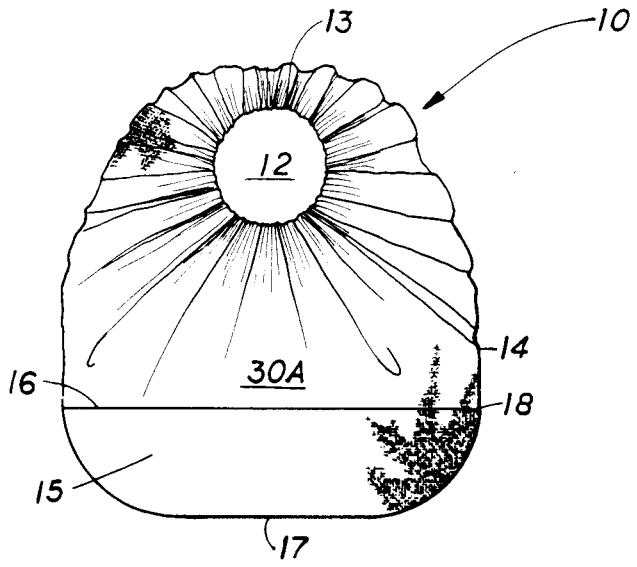
FIG. 1 is a front elevational view of the device of this invention.
Figure 4:
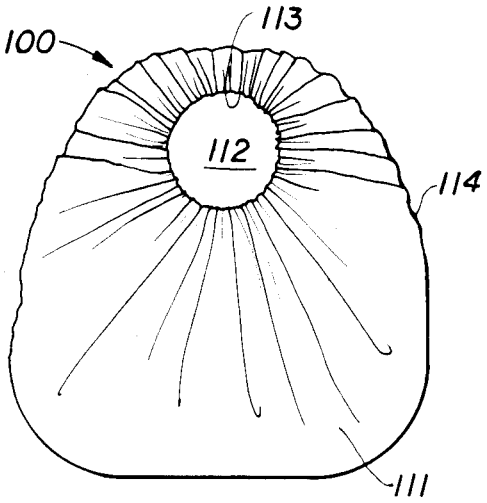
FIG. 4 is a variant of the device of FIG. 1, but without the pocket.

FIG. 4 illustrates the variant of the invention wherein the pocket is omitted. In FIG. 4 all of the parts discussed with respect to FIGS. 1–3 but for the pocket are seen, but renumbered in the 100 series. Thus element 12 is now 112. All parts shown in FIG. 4 have been discussed, with respect to the first embodiment. Further discussion is not needed.

As to packaging, since the cost of production is low, it is anticipated that the bib of this invention will be packaged in full and half dozens or in containers of 2 for sale by vending machines.

Since certain changes may be made in the above product without departing from the scope of the invention, herein involved, it is intended that all matter contained in the above description and shown in the accompanying drawings shall be interpreted as illustrative and not in a limiting sense.

I claim:

1. A disposable or few times rinsible protective bib comprising:

a substantially rectangular main panel having an upper transverse edge and a lower transverse edge, and being of two-ply construction, an outer sheet and an inner sheet the two sheets of said panel being coextensive, of flexible material, having a neck opening at the upper end thereof, said neck opening surrounded by a gathered portion to ensure a close fit to the wearer's neck;

and an optional pocket section having a transverse opening at the top thereof, extending up from the lower transverse edge of the main panel;

the front sheet being made of a few times rinsible water absorbent material, while the rear sheet is a non-permeable plastic film.

2. The device of claim 1 wherein the two sheets are a front sheet of an 80% nylon-20% polyester and a rear sheet of a polyvinylchloride film.

3. The device of claim 1 wherein the pocket section is made of the same material as the main panel.

4. The device of claim 1 wherein the opening is sized to closely fit the neck of the wearer.

5. The device of claim 1 further including said optional pocket.

6. The device of claim 2 wherein the opening is sized to closefit the neck of the wearer and including said optional pocket.

7. The product of claim 1 wherein the neck opening is spaced down from the top edge of the substantially rectangular main panel;

further including said optional pocket, and wherein the lower edges of said panel are chamfered.

* * * * *